US009991625B2

(12) United States Patent
Ozaki et al.

(10) Patent No.: US 9,991,625 B2
(45) Date of Patent: Jun. 5, 2018

(54) WATERPROOF CONNECTOR AND ELECTRONIC EQUIPMENT

(71) Applicant: EX COMPANY LIMITED, Matsuyama-shi, Ehime (JP)

(72) Inventors: Masanobu Ozaki, Ehime (JP); Shinya Yudate, Matsuyama (JP)

(73) Assignee: EX COMPANY LIMITED, Matsuyama-shi (JP)

( * ) Notice: Subject to any disclaimer, the term of this patent is extended or adjusted under 35 U.S.C. 154(b) by 0 days. days.

(21) Appl. No.: 14/900,057

(22) PCT Filed: Jun. 5, 2014

(86) PCT No.: PCT/JP2014/003006
§ 371 (c)(1),
(2) Date: Dec. 18, 2015

(87) PCT Pub. No.: WO2014/203486
PCT Pub. Date: Dec. 24, 2014

(65) Prior Publication Data

US 2016/0149337 A1 May 26, 2016

(30) Foreign Application Priority Data

Jun. 20, 2013 (JP) ..... 2013-129294

(51) Int. Cl.
*H01R 13/52* (2006.01)
*H01R 13/73* (2006.01)
(Continued)

(52) U.S. Cl.
CPC ..... *H01R 13/5219* (2013.01); *H01R 13/5202* (2013.01); *H01R 13/73* (2013.01);
(Continued)

(58) Field of Classification Search
CPC ..... H01R 13/6271; H01R 13/6275; H01R 13/5202; H01R 13/5219; H01R 33/965; H01R 13/52
(Continued)

(56) References Cited

U.S. PATENT DOCUMENTS 3,480,905 A 11/1969 Toedtman
4,283,597 A 8/1981 Cooper, Jr.
(Continued)

FOREIGN PATENT DOCUMENTS

CN 201789147 U 4/2011
CN 201820953 U 5/2011
(Continued)

OTHER PUBLICATIONS

International Search Report dated Jul. 22, 2014, issued in corresponding application No. PCT/JP2014/003006.

*Primary Examiner* — Tho D Ta
*Assistant Examiner* — Thang Nguyen
(74) *Attorney, Agent, or Firm* — Westerman, Hattori, Daniels & Adrian, LLP

(57) ABSTRACT

A waterproof connector provided herein is capable of reducing an area taken up by the connector while ensuring waterproof performance, achieving layout design of electronic equipment more freely, and contributing to size reduction of the electronic equipment. This waterproof connector is also capable of increasing the strength and durability of a shell dramatically. A waterproof connector (1) includes: a shell (2) of a seamless and substantially tubular shape; a resin support (3) accommodated in a wall pattern in the shell (2); a contact terminal (4) attached to the support (3) for example by insert molding and supported by the support (3); and a sealing member (5) provided around an outer periphery of the shell (2). Preferably, the shell (2) is provided with
(Continued)

a non-through recess (26) formed so as to bulge outward. The non-through recess (26) allows engagement of a hook of a plug.

16 Claims, 10 Drawing Sheets

(51) Int. Cl.
*H01R 13/627* (2006.01)
*H01R 12/72* (2011.01)
*H01R 13/405* (2006.01)
*H01R 24/62* (2011.01)

(52) U.S. Cl.
CPC ..... *H01R 12/724* (2013.01); *H01R 13/405* (2013.01); *H01R 13/6271* (2013.01); *H01R 13/6275* (2013.01); *H01R 24/62* (2013.01)

(58) Field of Classification Search
USPC ..... 439/271, 352, 587
See application file for complete search history.

(56) References Cited

U.S. PATENT DOCUMENTS

| | | | | |
|---|---|---|---|---|
| 4,941,850 | A * | 7/1990 | Ankers | H01R 9/0518 29/858 |
| 5,886,294 | A | 3/1999 | Scrimpshire et al. | |
| 6,007,378 | A | 12/1999 | Oeth | |
| 8,979,554 | B2 * | 3/2015 | Yudate | H01R 13/5202 439/271 |
| 9,472,888 | B2 * | 10/2016 | Song | H01R 13/5202 |
| 2004/0001323 | A1 | 1/2004 | Chen | |
| 2009/0191927 | A1 * | 7/2009 | Hong | H01R 13/5202 455/575.8 |
| 2010/0009570 | A1 | 1/2010 | Abramov | |
| 2010/0248533 | A1 | 9/2010 | Montena | |
| 2012/0108095 | A1 | 5/2012 | Liu et al. | |
| 2012/0315779 | A1 * | 12/2012 | Yudate | H01R 12/724 439/271 |
| 2014/0308833 | A1 * | 10/2014 | Fukami | B29C 70/72 439/271 |
| 2015/0325944 | A1 * | 11/2015 | Chien | H01R 13/5202 439/271 |

FOREIGN PATENT DOCUMENTS

| | | | | |
|---|---|---|---|---|
| CN | 102820579 | A | 12/2012 | |
| JP | 3097367 | B2 | 8/2000 | |
| JP | 2009-176734 | A | 8/2009 | |
| JP | 2012-009358 | A | 1/2012 | |
| JP | 2012-59381 | A | 3/2012 | |
| JP | 2012-059540 | A | 3/2012 | |
| JP | 2012-129078 | A | 7/2012 | |
| JP | 2012-195125 | A | 10/2012 | |
| JP | 2012195125 | * | 10/2012 | H01R 13/52 |
| WO | 2005/069710 | A1 | 7/2005 | |

* cited by examiner

WATERPROOF CONNECTOR AND ELECTRONIC EQUIPMENT

TECHNICAL FIELD

This invention relates to a connector used for electrical connection of various types of electronic equipment such as multifunctional mobile phones, multifunctional mobile information terminals, and mobile audio players. This invention more specifically relates to a waterproof connector having a waterproof function and electronic equipment.

BACKGROUND ART

Patent literature 1 describes a conventional waterproof connector having a waterproof function for electronic equipment. This waterproof connector is formed by providing a contact terminal in a resin housing by insert molding, attaching a shell to the resin housing by fitting a rear end portion of the shell to a front end portion of the housing from outside, and fitting a flange-like sealing member in a connection groove formed in the outer periphery of the resin housing. The sealing member has an outer periphery provided with a groove part. A bottom case and a top case to accommodate the waterproof connector therein each have a protrusion inserted tightly in the groove part, thereby forming a watertight structure. In this structure where the waterproof connector is incorporated in the bottom case and the top case of electronic equipment, water coming from outside of the shell of the waterproof connector is blocked by the sealing member and the watertight structure.

PRIOR ART LITERATURE

Patent Literature

Patent Literature 1: Japanese Patent Application Publication No. 2009-176734

SUMMARY OF INVENTION

Problem to be Solved by Invention

The aforementioned waterproof connector is formed by attaching the shell to the resin housing by fitting the rear end portion of the shell to the front end portion of the housing from outside and locating the sealing member on the resin housing in a position behind the shell. Thus, the length of the waterproof connector is increased to increase an area taken up by the waterproof connector. This imposes limitation on a layout inside multifunctional mobile phones, for example, making it difficult to achieve size reduction of these mobile phones, etc.

Like a shell of a general connector, the shell of the aforementioned waterproof connector is prepared by forming a metal plate into a plate-like member of a designated shape by press molding, rounding the plate-like member, and connecting opposite end portions of the plate-like member so as to make a fit therebetween. This produces a seam extending in the entire length of a direction where a plug is to be inserted. The shell with this seam is likely to start to fracture at the seam or a vicinity thereof if a plug inserted in the connector is pried strongly or prying force is applied to the plug many times, causing a problem of insufficient strength and durability.

This invention has been suggested in view of the aforementioned problem. It is an object of this invention to provide a waterproof connector and electronic equipment capable of reducing an area taken up by the connector while ensuring waterproof performance, increasing an available area inside the electronic equipment, achieving layout design of the electronic equipment more freely, and contributing to size reduction of the electronic equipment. It is another object of this invention to provide a waterproof connector and electronic equipment capable of increasing the strength and durability of a shell dramatically.

Means of Solving Problem

A waterproof connector according to this invention includes: a shell of a seamless and substantially tubular shape, the shell being made of metal; a resin support accommodated in a wall pattern in the shell; a contact terminal supported by the support; and a sealing member provided around an outer periphery of the shell.

In this structure, the support supporting the contact terminal is accommodated in the seamless shell and the sealing member is provided around the outer periphery of the shell. Thus, the length of the connector can be reduced while waterproof performance is ensured. Further, this structure does not require a resin housing outside the shell to be provided for preventing water from entering through a seam. This can make the connector thinner by the thickness of the resin housing. Thus, an area taken up by the connector can be reduced to increase an available area inside electronic equipment, thereby achieving layout design of the electronic equipment more freely and contributing to size reduction of the electronic equipment. Eliminating the need of providing the resin housing outside or behind the shell makes a resin material for the resin housing unnecessary. Thus, manufacturing cost can be reduced. Further, the seamless shell has no seam that is likely to cause fracture if a plug inserted in the connector is pried strongly or prying force is applied to the plug many times. This can increase the strength and durability of the shell dramatically.

The waterproof connector according to this invention is characterized in that the shell is provided with a stepped part abutting on the sealing member and formed in a peripheral pattern.

In this structure, as a result of the abutting contact between the sealing member and the stepped part, the sealing member can be located in and attached to a designated position on the outer periphery of the shell and can be attached to this designated position stably.

The waterproof connector according to this invention is characterized in that the shell is provided with a non-through recess formed so as to bulge outward. The non-through recess allows engagement of a hook of a plug.

This structure allows engagement of a hook of a plug inserted in the waterproof connector, so that the plug can be inserted in the waterproof connector stably with required attachment strength. The non-through recess not penetrating the shell is provided as a part where the hook of the plug can be engaged. This can increase the strength and durability of the shell further.

The waterproof connector according to this invention is characterized in that the shell is formed of a non-perforated surface extending at least in an area of the shell ahead of a front surface of the support.

In this structure, the shell is formed of the non-perforated surface with no perforated part extending at least in the area of the shell ahead of the front surface of the support. This can increase the strength and durability of the shell further. Unlike in the case where a through hole is formed and water flows through this through hole as a path, forming the shell using the non-perforated surface removes the occurrence of such a water flow, thereby preventing entry of water into a hard-to-dry place. Further, the sealing member is attached to an anteroposterior position in a direction where a plug is to be inserted that can be determined with a considerably increased degree of freedom.

The waterproof connector according to this invention is characterized in that the shell is provided with an engagement hole that allows engagement of a hook of a plug and the sealing member is provided around the outer periphery of the shell and behind the engagement hole.

This structure having the engagement hole in the shell can be achieved only by forming the engagement hole in an appropriate part independently of a different part. This increases a degree of freedom of the shape and provides responsiveness to customization easily. Thus, various requests for the shape of the shell can be responded flexibly while the strength and durability of the shell are increased. Further, the size of the shell can be reduced by reducing the height of the shell in a thickness direction, for example, while the strength and durability of the shell are increased. Additionally, providing the sealing member around the outer periphery of the shell and behind the engagement hole prevents entry of water through the engagement hole. This makes it possible to ensure waterproof performance with the sealing member without the need of providing a resin housing outside the shell.

The waterproof connector according to this invention is characterized in that a rear-side receiving part like a recess is filled with a sealing material. The receiving part is formed of the shell and the support.

This structure can reliably prevent entry of water from the inside of the shell into a place adjacent to a circuit board of electronic equipment independently of a condition of the support accommodated in the shell.

The waterproof connector according to this invention is characterized in that the support is fitted in the shell in a watertight manner and the shell includes a rear section provided with an abutting part abutting on a rear surface of the support.

In this structure, a watertight structure formed by the shell and the support can prevent entry of water from the inside of the shell into a place adjacent to the circuit board of the electronic equipment reliably. The abutting contact of the rear surface of the support with the abutting part stabilizes a fitting condition of the support while contributing to retention of the support.

Electronic equipment of this invention includes the waterproof connector of this invention and a case accommodating the waterproof connector. A watertight structure is formed by pressing the sealing member directly or indirectly with the case.

This structure can prevent entry of water from between the waterproof connector and the case into a place adjacent to a circuit board of the electronic equipment. Further, the electronic equipment of this structure achieves the effect of the waterproof connector of this invention.

Advantageous Effects of Invention

This invention is capable of reducing an area taken up by the connector while ensuring waterproof performance, increasing an available area inside the electronic equipment, achieving layout design of the electronic equipment more freely, and contributing to size reduction of the electronic equipment. This invention is also capable of increasing the strength and durability of the shell dramatically.

EMBODIMENTS FOR CARRYING OUT INVENTION

Waterproof Connector According to First Embodiment

Figure 1:
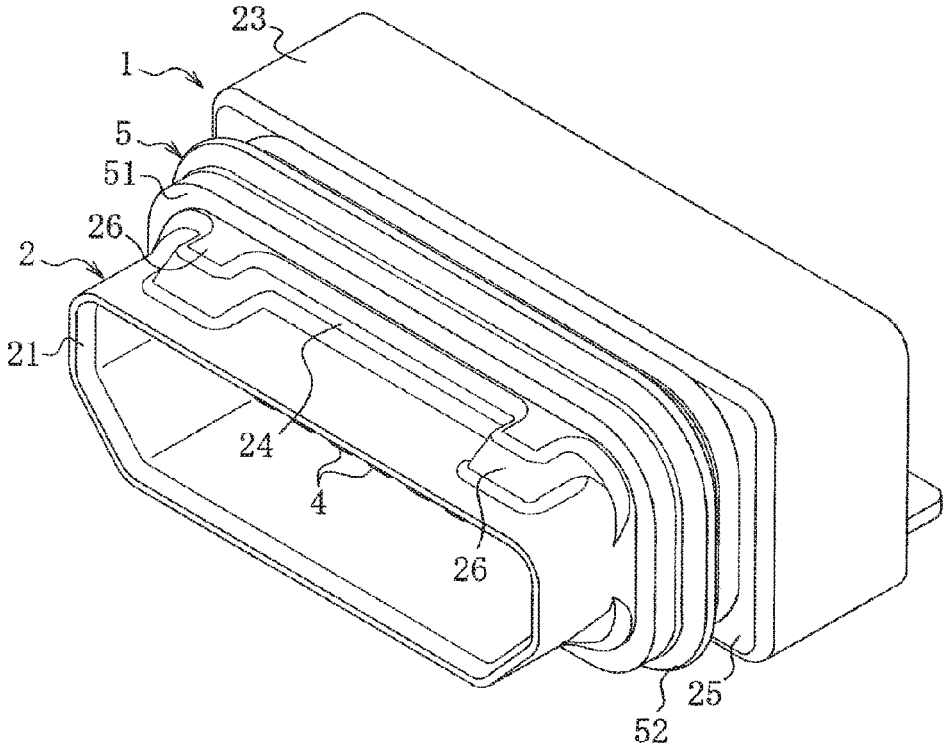
FIG. 1 is an oblique front perspective view of a waterproof connector according to a first embodiment of this invention.
Figure 2:
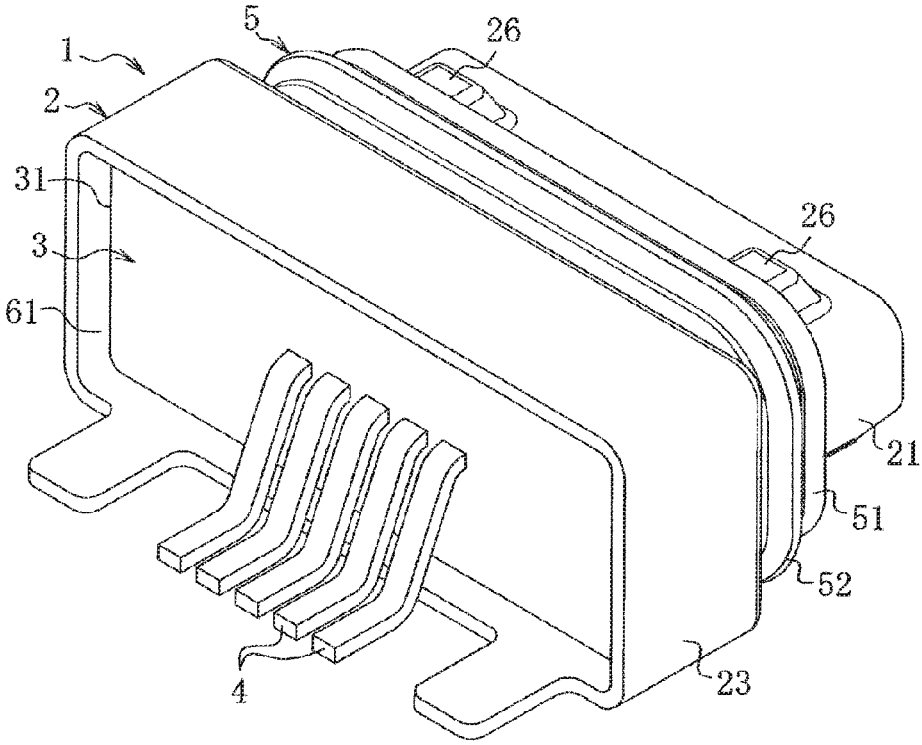
FIG. 2 is an oblique rear perspective view of the waterproof connector according to the first embodiment.
Figure 3:
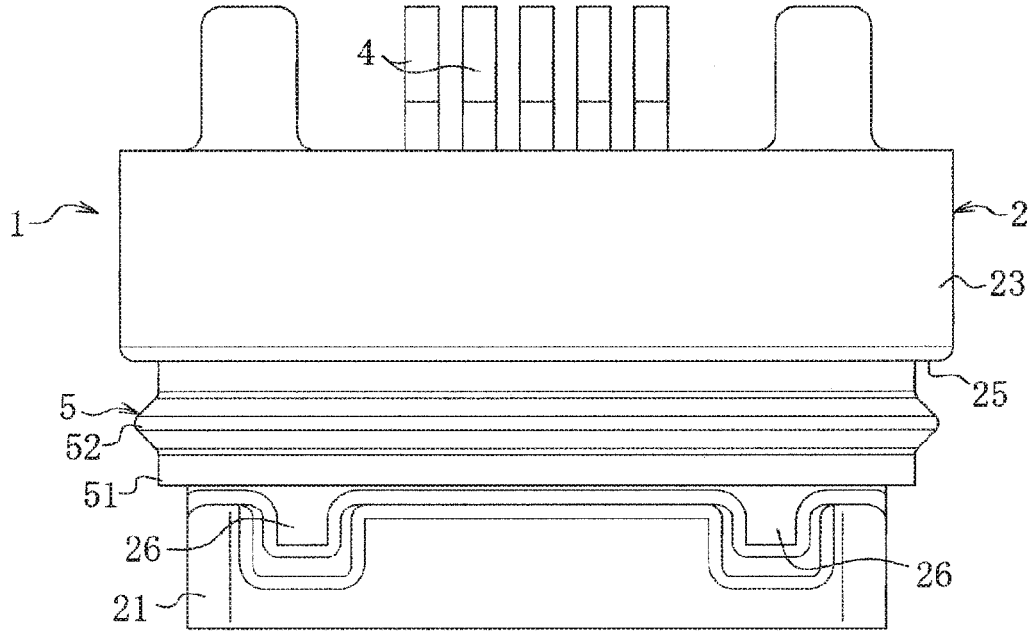
FIG. 3 is a plan view of the waterproof connector according to the first embodiment.
Figure 4:
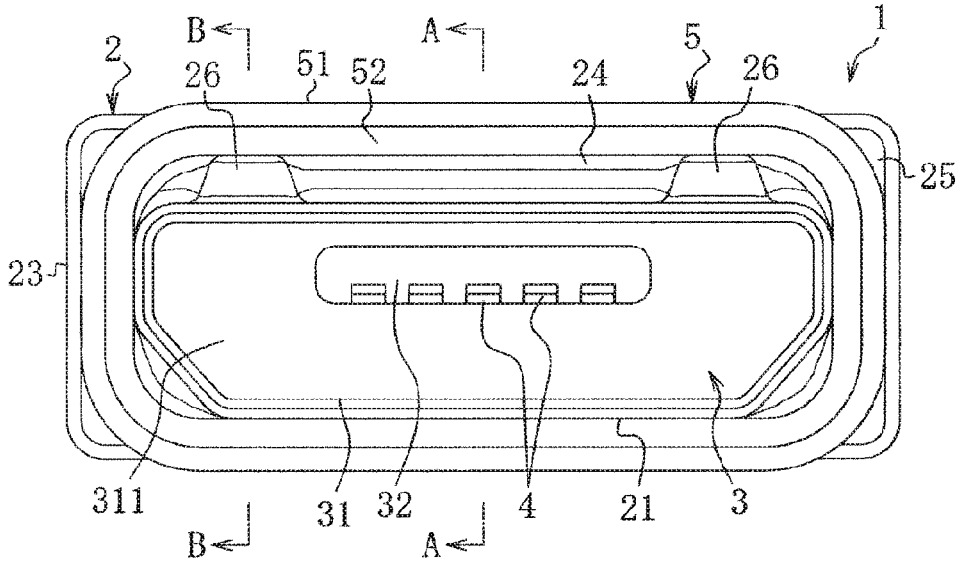
FIG. 4 is a front view of the waterproof connector according to the first embodiment.

A waterproof connector 1 according to a first embodiment of this invention is used in mobile electronic equipment, etc. such as multifunctional mobile phones, multifunctional mobile information terminals, and mobile audio players. The waterproof connector 1 conforms to a standard such as the micro-USB standard.

As shown in FIGS. 1 to 7, the waterproof connector 1 according to the first embodiment includes a shell 2 of a seamless and substantially tubular shape, a resin support 3 accommodated in a wall pattern in the shell 2, contact terminals 4 supported by the support 3, and a sealing member 5 provided around the outer periphery of the shell 2. The waterproof connector 1 is attached to electronic equipment by being accommodated in a case of the electronic equipment.

The shell 2 is formed by drawing press work on a metal flat plate, for example. The shell 2 is formed into a substantially rectangular tubular shape without a seam. The shell 2 has a stepped part formed in a direction where a plug is to be inserted. In this example, the shell 2 has a stepped part 24 formed on the upper surface of the shell 2 so as to bulge outward and extend from a front section 21 adjacent to a place where the plug is to be inserted to an intermediate section 22 thicker than the front section 21. The shell 2 has a stepped part 25 formed on the peripheral surface of the shell 2 so as to bulge outward in a peripheral pattern and extend from the intermediate section 22 to a rear section 23 thicker than and wider than the intermediate section 22. The sealing member 5 described later abuts in a peripheral pattern on the stepped part 25 of the peripheral pattern.

The upper surface of the shell 2 is provided with non-through recesses 26 formed in two places so as to bulge outward and protrude forward from the stepped part 24. The non-through recesses 26 are each formed into a recessed shape that allows engagement of a claw-shaped hook of a plug such as a micro-USB plug when this plug is inserted in the shell 2. For example, the non-through recess 26 is formed so as to bulge outward in a step of the drawing press work on the metal flat plate for forming the shell 2.

The shell 2 is formed of a non-perforated surface extending at least in an area of the shell 2 ahead of a front surface 311 of the support 3 including the front section 21 adjacent to the place where a plug is to be inserted and the intermediate section 22, for example. In this example, the shell 2 is formed of a non-perforated surface with no perforated part extending through the front section 21, the intermediate section 22, and the rear section 23 entirely.

The support 3 is made of insulating hard resin. The support 3 is formed in a wall pattern so as to block the back of the shell 2. In this example, the support 3 is inserted and fitted in the rear section 23 of the shell 2 in a manner such that the front surface 311 of body 31 like a substantially rectangular parallelepiped of the support 3 abuts on the inner surface of the stepped part 25.

The contact terminals 4 are buried in a part of the support 3 by insert molding. The contact terminals 4 are attached to the support 3 so as to form a watertight structure by the insert molding. If a receiving part 61 is to be filled with a sealing material 62 described later, the contact terminals 4 can be installed on the support 3 without forming a watertight structure. For example, the contact terminals 4 can be attached to the support 3 by being fitted and inserted in through holes in the support 3.

The contact terminals 4 are each arranged along one side of a protruding part 32 of the support 3 protruding forward and introduced into the shell 2. The contact terminals 4 are each exposed in the shell 2 in a manner such that the contact terminal 4 can contact and can be electrically continuous with a contact of a plug. Further, the contact terminals 4 are pulled out of the body 31 from a rear side thereof and connected to a circuit board of the electronic equipment not shown in the drawings. Appropriate ones of the contact terminals 4 can be a power supply terminal and a ground terminal.

The sealing member 5 is made of soft resin such as elastomer and formed like a ring of a substantially rectangular frame shape. The sealing member 5 has a body 51 substantially rectangular in cross section and a protruding strip 52 having a shape like a ridge in cross section protruding outward from the body 51. The sealing member 5 can be formed using an appropriate material that achieves sealing with a waterproof function. Not only the soft resin such as elastomer but also an O-ring or a water repelling member can be used for forming the sealing member 5. If the sealing member 5 is made of the water repelling member, the water repelling member may be a coating layer of a water repellent and the sealing member 5 can be configured in a manner such that a gap is formed between a case-side member such as the case of the electronic equipment and the water repelling member while the water repelling member does not abut on the case-side member.

The sealing member 5 is fitted to the outer periphery of the intermediate section 22 in a manner such that one side surface of the body 51 abuts on an outer side surface of the stepped part 25. The sealing member 5 is fitted to the intermediate section 22 from outside and located in a fixed position. In the illustration of the drawings, the sealing member 5 is fitted to the outer periphery of the intermediate section 22 having a planar peripheral surface. Alternatively, the sealing member 5 can be configured so as to extend in a peripheral pattern by forming a fitting groove into a peripheral pattern in the intermediate section 22 and fitting the sealing member 5 by fitting a protruding strip formed so as to protrude toward the inside of the sealing member 5 in this fitting groove, for example. The shell 2 is formed of a non-perforated surface with no perforated part extending through the front section 21, the intermediate section 22, and the rear section 23 entirely. Thus, the sealing member 5 can be attached in a position that can be determined arbitrarily in an anterior-posterior direction of the shell 2.

Figure 5:
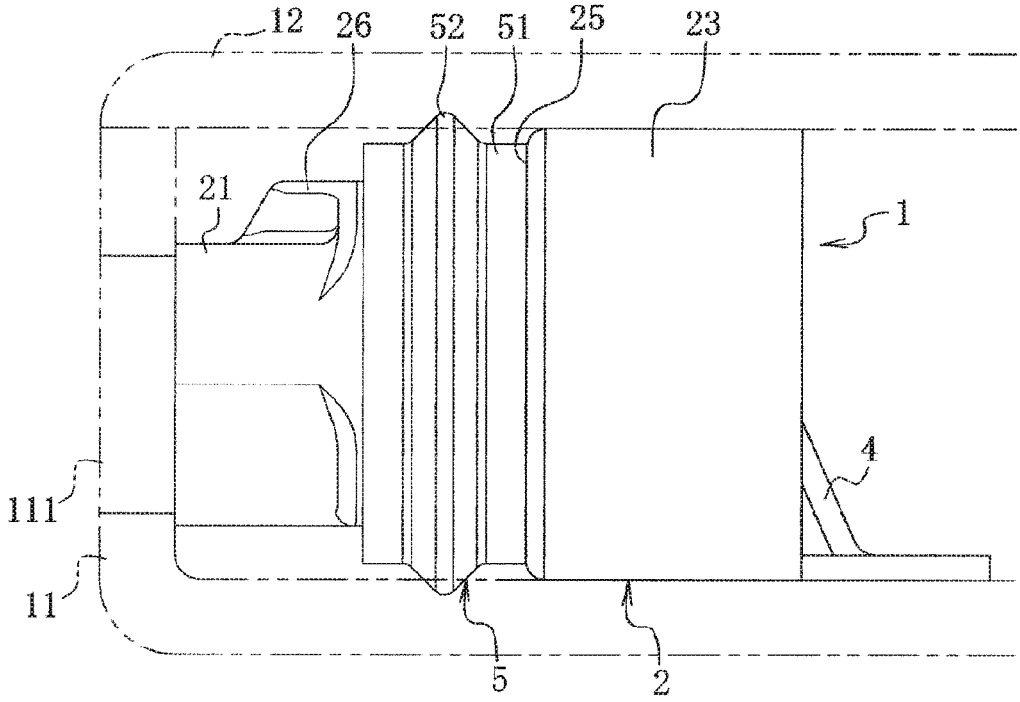
FIG. 5 is an enlarged side view of the waterproof connector according to the first embodiment.
Figure 6:
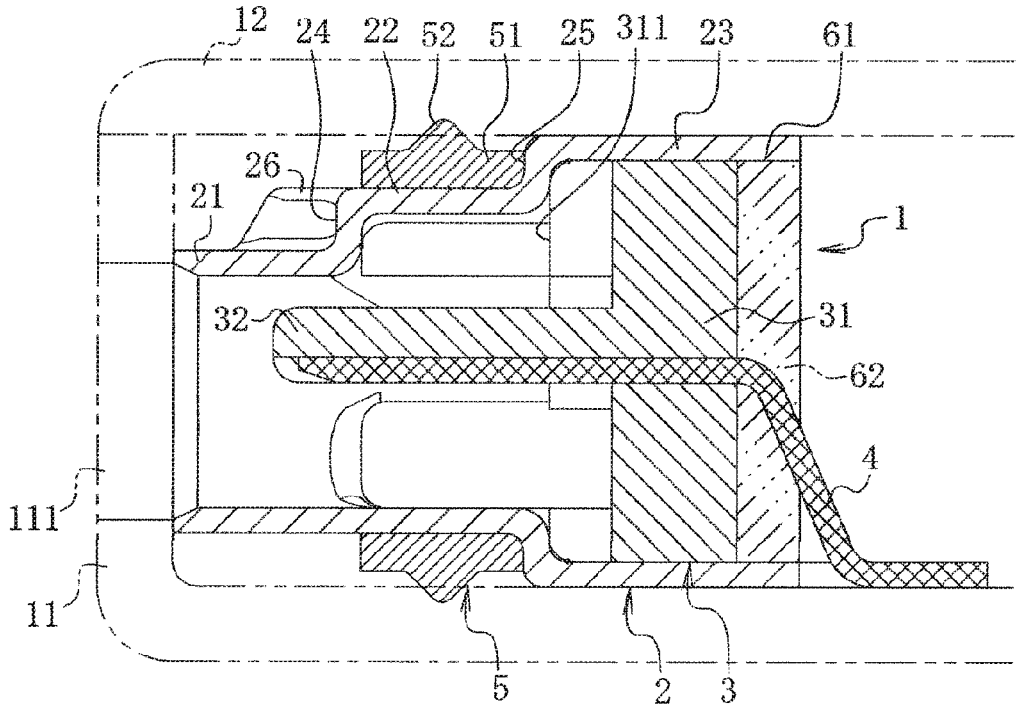
FIG. 6 is an enlarged sectional view taken along line A-A of FIG. 4.
Figure 7:
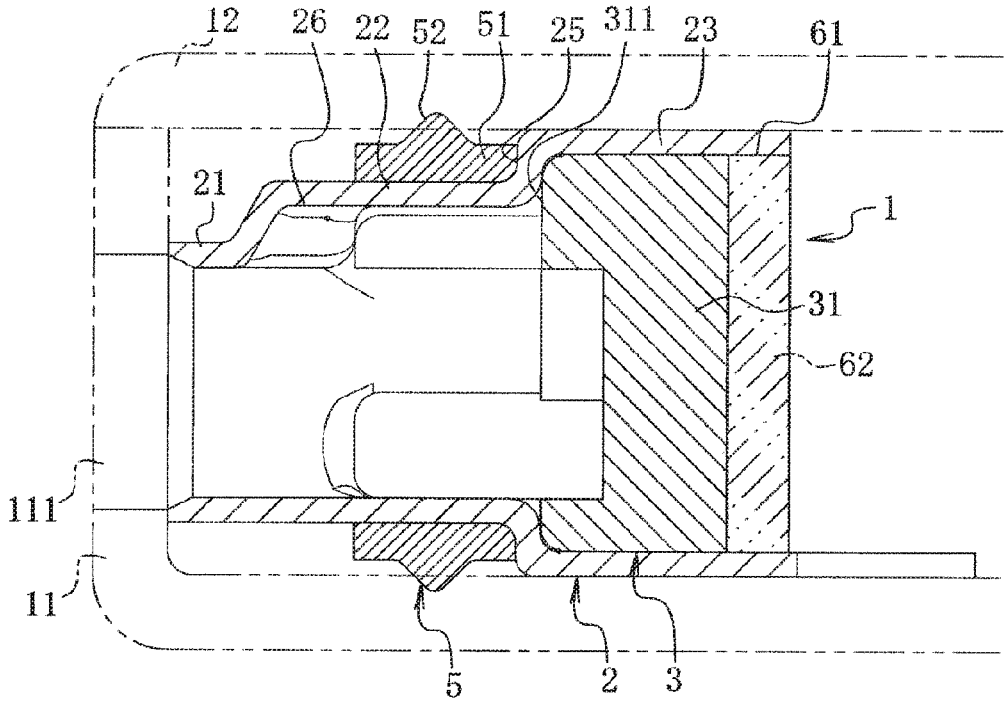
FIG. 7 is an enlarged sectional view taken along line B-B of FIG. 4.

The protruding strip 52 has a tip that abuts on a bottom case 11 and a top case 12 forming the case of the electronic equipment, for example, in a manner such that the tip is pressed with the bottom case 11 and the top case 12, thereby forming a watertight structure (see FIGS. 5 to 7). Referring to FIGS. 5 to 7, 111 is an opening for plug insertion. In the illustration of the drawings, this opening 111 is provided at a side wall of the bottom case 11.

The watertight structure may be formed by making a fit of the protruding strip 52 in a groove part of the bottom case 11 and a groove part of the top case 12. Instead of being formed by pressing the sealing member 5 with the case directly, the watertight structure can be formed by pressing the sealing member 5 with the case indirectly. For example, the watertight structure can be formed by making abutting contact of the sealing member 5 with a seal receiving member such as rubber provided to the bottom case 11 or the top case 12, or both of the bottom case 11 and the top case 12 so as to press the sealing member 5 with this seal receiving member.

The rear section 23 of the shell 2 protrudes backward further than the rear surface of the body 31 of the support 3. The rear-side receiving part 61 like a recess formed of the protruding portion of the rear section 23 and the rear surface of the body 31 is filled with the sealing material 62 that is formed by pouring bond etc. and hardening the bond in the receiving part 61. Forming the sealing material 62 in the receiving part 61 makes it possible to more reliably prevent entry of water into a circuit board of the electronic equipment arranged adjacent to the rear surface of the support 3, for example. If the support 3 is to be accommodated in the shell 2 by fitting the support 3 in a watertight manner in the shell 2, pouring the sealing material 62 can be omitted. Instead of pouring the sealing material 62, the support 3 can also be accommodated in the shell 2 by providing an abutting part such as a bent part same as a bent part 231*a* of a shell 2*a* according to a second embodiment described later to the rear section 23 and making abutting contact of the abutting part with the rear surface of the support 3.

The waterproof connector 1 according to the first embodiment can be manufactured by any applicable method. For example, the waterproof connector 1 can be formed favorably by forming the shell 2 using drawing press work on a metal flat plate into an entirely seamless and substantially rectangular tubular shape with the stepped parts 24 and 25 and the non-through recess 26 bulging outward.

Figure 8:
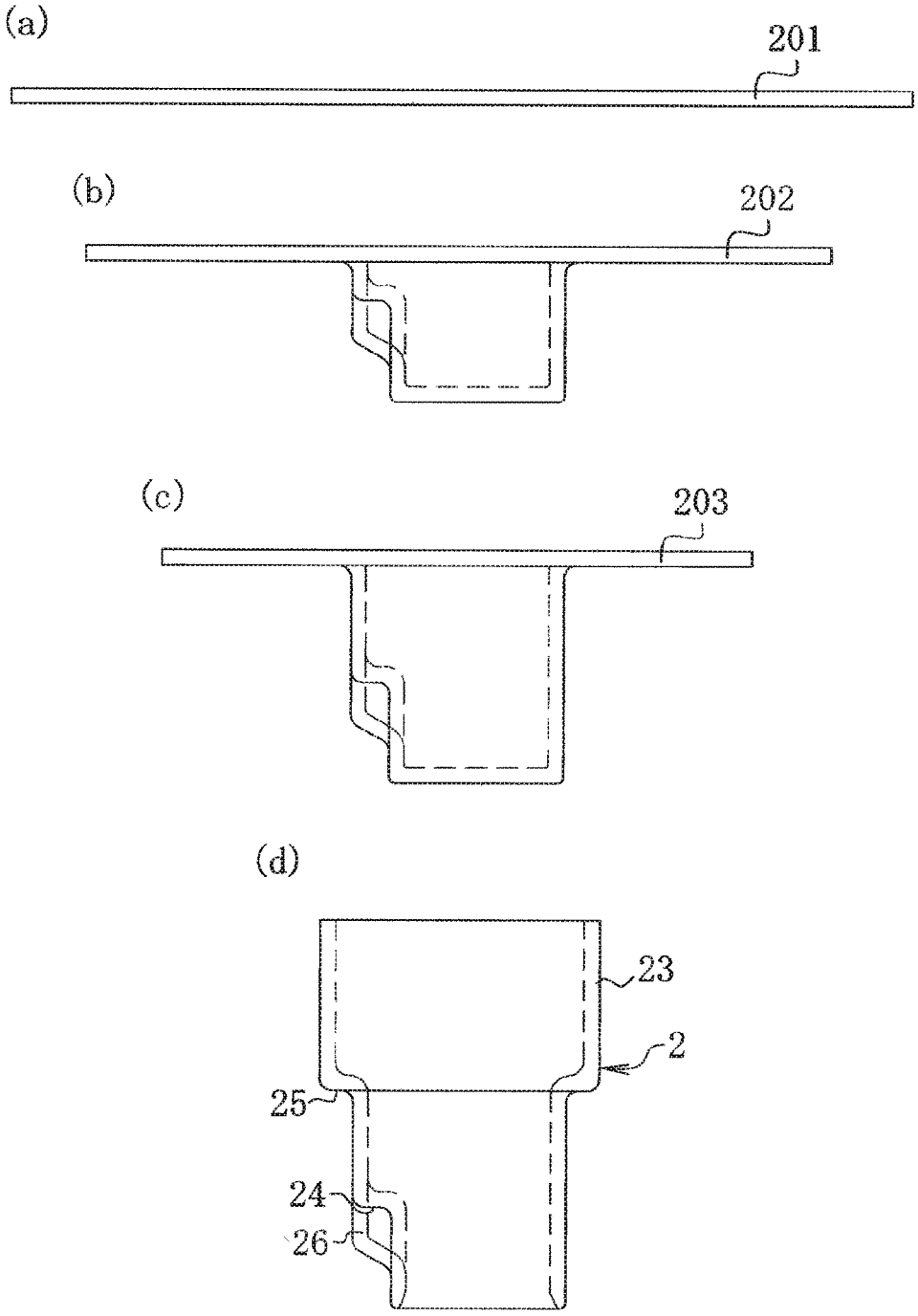
FIGS. 8(*a*) to 8(*d*) are conceptual explanatory views showing a step of forming a shell by drawing press work on a metal flat plate.
Figure 9:
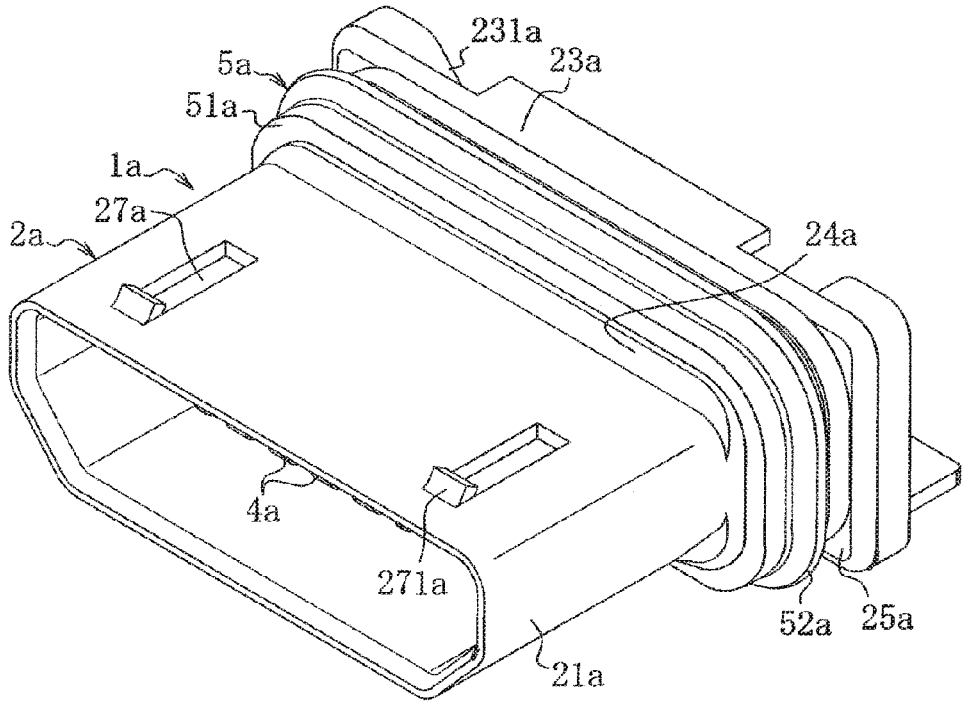
FIG. 9 is an oblique front perspective view of a waterproof connector according to a second embodiment of this invention.
Figure 10:
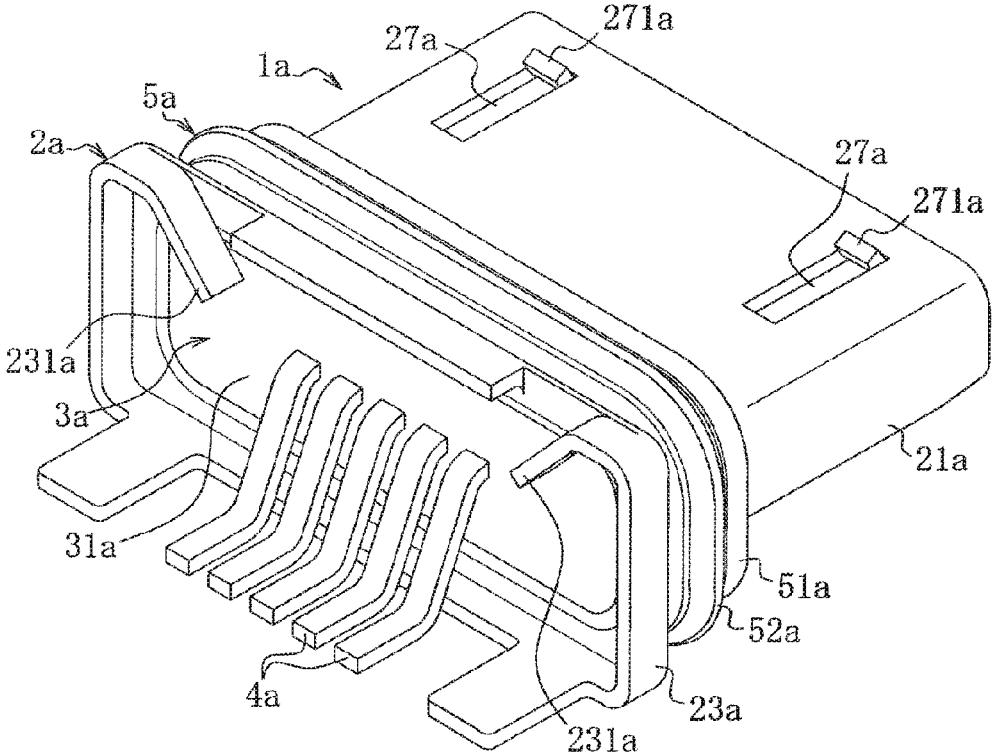
FIG. 10 is an oblique rear perspective view of the waterproof connector according to the second embodiment.
Figure 11:
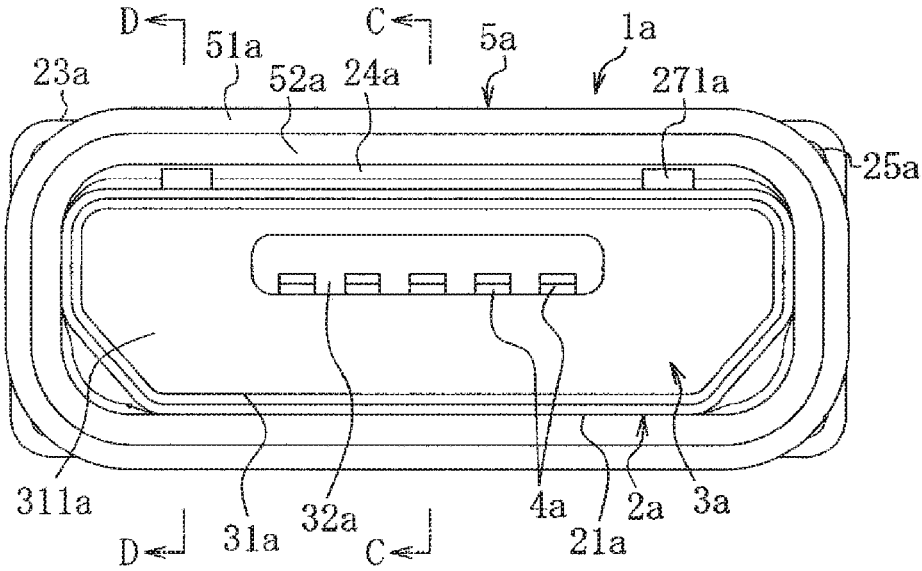
FIG. 11 is a front view of the waterproof connector according to the second embodiment.

As shown in FIG. 8, regarding formation of the shell 2 by the drawing press work on the metal flat plate, the drawing press is performed in stages on a metal flat plate 201 to form respective patterns of the front section 21, the intermediate section 22, and the rear section 23. Further, while a pattern of the non-through recess 26 is formed so as to bulge outward, the metal flat plate 201 is processed into the shape of a work 202 and that of a work 203 sequentially. Further, an opening for plug insertion is punched to penetrate a tip, thereby forming the shell 2.

Then, the support 3 with the contact terminals 4 formed by insert molding is accommodated in the shell 2 so as to be fitted in the rear section 23. Further, the sealing member 5 is fitted to the outer periphery of the intermediate section 22 in a manner such that a lateral portion of the sealing member 5 abuts on the stepped part 25, thereby obtaining the waterproof connector 1. The sealing material 62 is poured into and hardened in the rear-side receiving part 61 like a recess formed of the protruding portion of the rear section 23 and the rear surface of the body 31. This implements a waterproof process of preventing entry of water into the shell 2.

According to the first embodiment, unlike a connector formed by attaching a rear end portion of a shell to a front end portion of a resin housing, the waterproof connector 1 is formed by accommodating the support 3 supporting the contact terminals 4 in the seamless shell 2. As a result, the length of the connector can be reduced while waterproof performance is ensured. Further, the absence of the resin housing outside the shell 2 can make the connector thinner by the thickness of the housing. This can reduce an area taken up by the connector to increase an available area inside the electronic equipment, thereby achieving layout design of the electronic equipment more freely and contributing to size reduction of the electronic equipment.

Eliminating the need of providing a resin housing outside or behind the shell 2 makes a resin material for the resin housing unnecessary. Thus, manufacturing cost can be reduced.

The shell 2 of a seamless and substantially tubular shape has no seam that is likely to cause fracture if a plug inserted in the connector is pried strongly or prying force is applied to the plug many times. This can increase the strength and durability of the shell 2 dramatically.

As a result of the abutting contact between the sealing member 5 and the stepped part 25, the sealing member 5 can be located in and attached to a designated position on the outer periphery of the shell 2 and can be attached to this designated position stably.

The presence of the non-through recess 26 of the shell 2 allows engagement of a hook of a plug inserted in the waterproof connector 1, so that the plug can be inserted in the waterproof connector 1 stably with required attachment strength. The non-through recess 26 not penetrating the shell 2 is provided as a part where the hook of the plug can be engaged. This can increase the strength and durability of the shell 2 further.

The shell 2 is formed of a non-perforated surface with no perforated part. This can increase the strength and durability of the shell 2 further. Unlike in the case where a through hole is formed and water flows through this through hole as a path, forming the shell 2 using the non-perforated surface removes the occurrence of such a water flow, thereby preventing entry of water into a hard-to-dry place. Further, the sealing member 5 can be attached to any anteroposterior position of the shell 2 in the direction where a plug is to be inserted. Thus, the position where the sealing member 5 is to be attached can be determined with a considerably increased degree of freedom.

If drawing press work on a metal flat plate is employed to form the shell 2 into a seamless and substantially tubular shape, the seamless shell 2 of high strength and high durability can be manufactured easily at low cost. Additionally, if the non-through recess 26 is formed so as to bulge outward during this drawing press work, the seamless and substantially tubular shape of the shell 2 and the non-through recess 26 can be formed in the same drawing press step. This achieves efficient manufacture of high productivity. Further, forming the shell 2 as a shell without a through hole can eliminate punching work.

Waterproof Connector According to Second Embodiment

A waterproof connector 1*a* according to a second embodiment of this invention is also used in mobile electronic equipment, etc. such as multifunctional mobile phones, multifunctional mobile information terminals, and mobile audio players. The waterproof connector 1*a* conforms to a standard such as the micro-USB standard.

As shown in FIGS. 9 to 14, the waterproof connector 1*a* according to the second embodiment also includes a shell 2*a* of a seamless and substantially tubular shape, a resin support 3*a* accommodated in a wall pattern in the shell 2*a*, contact terminals 4*a* supported by the support 3*a*, and a sealing member 5*a* provided around the outer periphery of the shell 2*a*. The waterproof connector 1*a* is attached to electronic equipment by being accommodated in a case of the electronic equipment.

The shell 2*a* is formed by performing drawing press on a metal flat plate and forming an engagement hole using cutting and bending, for example. Alternatively, the shell 2*a* is formed by die casting. The shell 2*a* is formed into a substantially rectangular tubular shape without a seam. The shell 2*a* has a stepped part formed in a direction where a plug is to be inserted. In this example, the shell 2*a* has a stepped part 24*a* formed on the upper surface of the shell 2*a* so as to bulge outward and extend from a front section 21*a* longer than the front section 21 of the first embodiment in an anterior-posterior direction to an intermediate section 22*a* thicker than the front section 21*a*. The shell 2*a* has a stepped part 25*a* formed on the peripheral surface of the shell 2*a* so as to bulge outward in a peripheral pattern and extend from the intermediate section 22*a* to a rear section 23*a* thicker than and wider than the intermediate section 22*a*. The rear section 23*a* is formed to be shorter than the rear section 23 of the first embodiment. The sealing member 5*a* abuts in a peripheral pattern on the stepped part 25*a* of this peripheral pattern.

The upper surface of the shell 2*a* is provided with long and thin engagement holes 27*a* formed in two places extending longitudinally in the anterior-posterior direction. Each of the engagement holes 27*a* has a front end provided with a cut and bent part 271*a* tilted upward and rearward. The cut and bent part 271*a* is formed as a cut and raised part in the shell 2*a* in a place near the front end of the engagement hole 27*a*. The engagement hole 27*a* and the cut and bent part 271*a* are formed in a manner such that a claw-shaped hook of a plug such as a micro-USB plug can be inserted in the engagement hole 27*a* and engaged with the cut and bent part 271*a* when this plug is inserted in the shell 2*a*.

Like that of the first embodiment, the support 3*a* is made of insulating hard resin and is formed in a wall pattern so as to block the back of the shell 2*a*. In this example, the support 3*a* is inserted and fitted in the intermediate section 22*a* of the shell 2*a* in a manner such that a front surface 311*a* of a body 31*a* like a substantially rectangular parallelepiped of the support 3*a* is located in the front section 21*a* and a stepped surface 312*a* on the upper surface of the body 31*a* abuts on the inner surface of the stepped part 24*a*. The support 3*a* is fitted to and accommodated in the shell 2*a* in a watertight manner.

The support 3*a* accommodated in a designated position in the shell 2*a* has a rear surface 313*a* abutting on an abutting part provided to the rear section of the shell 2*a*. In this embodiment, the rear surface 313*a* abuts on a bent part 231*a* formed by cutting the upper surface of the rear section 23*a* of the shell 2*a* and bending the cut inward. In the illustration of the drawings, the bent part 231*a* includes a pair of right and left bent parts 231*a* abutting on the rear surface 313*a*. In an applicable structure alternative to this structure, the abutting part such as the bent part 231*a* is omitted from the rear section 23*a*. In a different applicable structure, like in the first embodiment, the support 3*a* is fitted to and accommodated in the shell 2*a* so as to form a watertight structure or not to form a watertight structure and a receiving part like a recess formed of the rear section 23*a* of the shell 2*a* and the rear surface 313*a* of the support 3*a* is filled with a sealing material.

The contact terminals 4*a* are buried in a part of the support 3*a* by insert molding. The contact terminals 4*a* are attached to the support 3*a* so as to form a watertight structure by the insert molding. The contact terminals 4*a* are each arranged along one side of a protruding part 32*a* of the support 3*a* protruding forward and introduced into the shell 2*a*. The contact terminals 4*a* are each exposed in the shell 2*a* in a manner such that the contact terminal 4*a* can contact and can be electrically continuous with a contact of a plug. Further, the contact terminals 4 are pulled out of the body 31*a* from a rear side thereof and connected to a circuit board of the electronic equipment not shown in the drawings. Appropriate ones of the contact terminals 4*a* can be a power supply terminal and a ground terminal.

Like that of the first embodiment, the sealing member 5*a* is made of soft resin such as elastomer and formed like a ring of a substantially rectangular frame shape. The sealing member 5*a* has a body 51*a* substantially rectangular in cross section and a protruding strip 52*a* having a shape like a ridge in cross section protruding outward from the body 51*a*. The sealing member 5*a* can be formed using an appropriate material that achieves sealing with a waterproof function. Not only the soft resin such as elastomer but also an O-ring or a water repelling member can be used for forming the sealing member 5*a*, for example.

The sealing member 5*a* is fitted to the outer periphery of the intermediate section 22*a* in a manner such that one side surface of the body 51*a* abuts on an outer side surface of the stepped part 25*a*. The sealing member 5*a* is fitted to the intermediate section 22*a* from outside and located in a fixed position. The sealing member 5*a* is fitted to the outer periphery of the intermediate section 22*a* having a planar peripheral surface. Like that of the first embodiment, the sealing member 5*a* may alternatively be configured so as to extend in a peripheral pattern by forming a fitting groove into a peripheral pattern in the intermediate section 22*a* and fitting the sealing member 5*a* by fitting a protruding strip formed so as to protrude toward the inside of the sealing member 5*a* in this fitting groove, for example. The sealing member 5*a* can be attached in a position that can be determined arbitrarily in an anterior-posterior direction of the shell 2*a* as long as this position is behind the engagement hole 27*a*.

Figure 12:
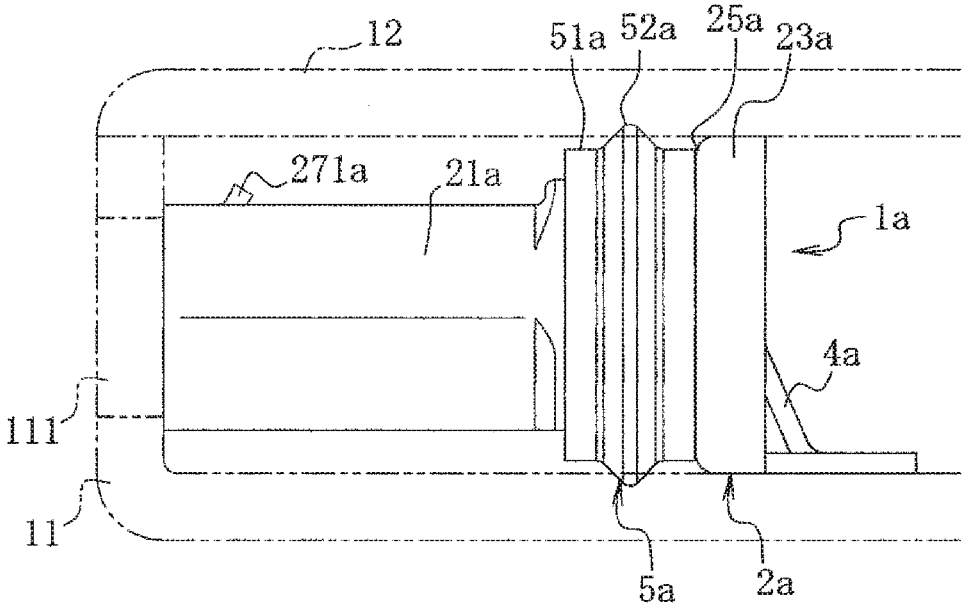
FIG. 12 is a side view of the waterproof connector according to the second embodiment.
Figure 13:
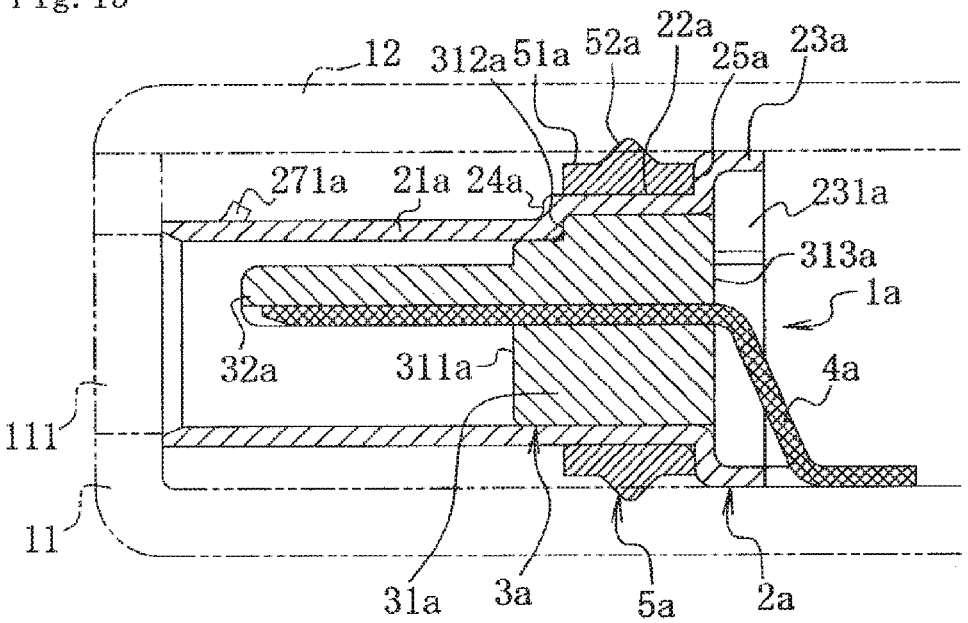
FIG. 13 is an enlarged sectional view taken along line C-C of FIG. 11.
Figure 14:
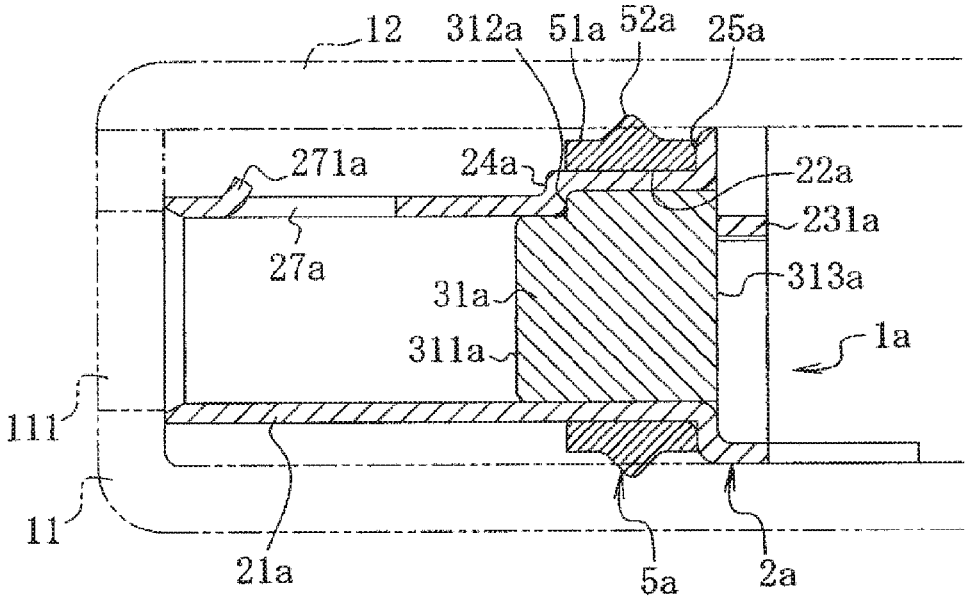
FIG. 14 is an enlarged sectional view taken along line D-D of FIG. 11.

The protruding strip 52*a* has a tip that abuts on a bottom case 11 and a top case 12 having an opening 111 for plug insertion and forming the case of the electronic equipment same as that of the first embodiment, for example, in a manner such that the tip is pressed with the bottom case 11 and the top case 12, thereby forming a watertight structure (see FIGS. 12 to 14). Like in the first embodiment, the watertight structure may be formed by making a fit of the protruding strip 52*a* in a groove part of the bottom case 11 and a groove part of the top case 12. Instead of being formed by pressing the sealing member 5*a* with the case directly, the watertight structure can be formed by pressing the sealing member 5 with the case indirectly. For example, the watertight structure can be formed by making abutting contact of the sealing member 5*a* with a seal receiving member such as rubber provided to the bottom case 11 or the top case 12, or both of the bottom case 11 and the top case 12 so as to press the sealing member 5*a* with this seal receiving member.

Figure 15:
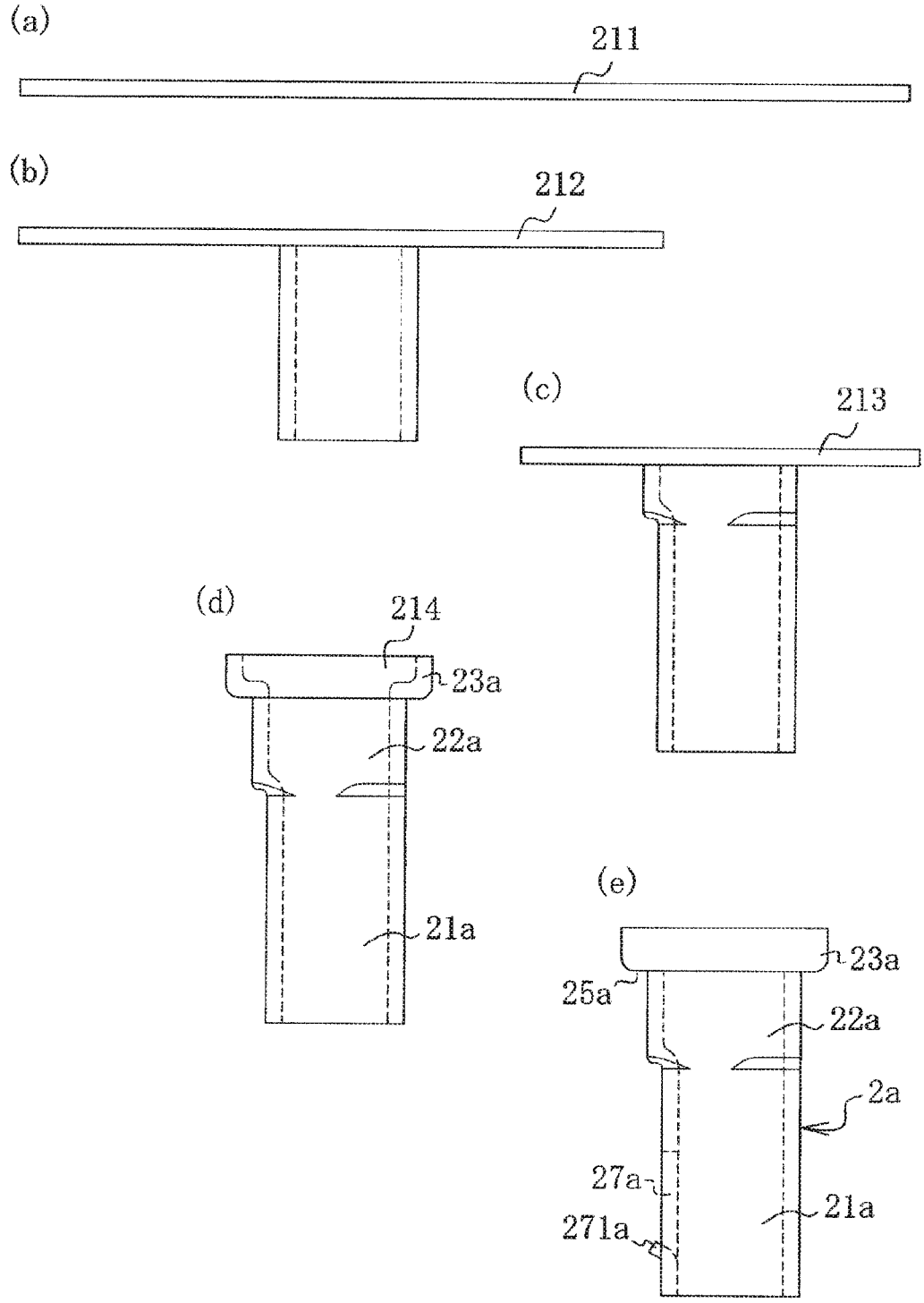
FIGS. 15(*a*) to 15(*e*) are conceptual explanatory views showing a step of forming a shell by drawing press and cutting and bending on a metal flat plate.

The waterproof connector 1*a* according to the second embodiment can be manufactured by any applicable method. As shown in FIG. 15, for example, drawing press is performed in stages on a metal flat plate 211 to form the metal flat plate 211 into the shape of a work 212 having a pattern of the front section 21*a* and the shape of a work 213 having a pattern of the intermediate section 22*a* sequentially. Then, the work 213 is brought to a condition including the front section 21*a*, the intermediate section 22*a*, and the rear section 23*a*. Further, an opening for plug insertion is punched to penetrate a tip, thereby obtaining a work 214 of the shell 2*a* of an entirely seamless and substantially tubular shape.

Next, in a designated place of the front section 21*a* of the work 214, cuts are formed on opposite sides of a position corresponding to the front end or vicinity thereof and a part between the cuts is raised by being bent, thereby forming the cut and bent part 271*a* and a front end neighboring region of the engagement hole 27*a*. Further, the front section 21*a* is punched in a position behind the front neighboring region of the engagement hole 27*a*, thereby forming a rear-side region of the engagement hole 27*a*, for example. In this way, the front section 21*a* is cut and bent to form the engagement hole 27*a* with the cut and bent part 271*a*.

Then, the support 3*a* with the contact terminals 4*a* formed by insert molding is fitted in the intermediate section 22*a* and accommodated in the shell 2*a* so as to form a watertight structure. Further, cutting and bending work is performed on a designated place of the rear section 23*a* to form the bent part 231*a* and the bent part 231*a* is made to abut on the rear surface 313*a* of the support 3*a*. Further, the sealing member 5*a* is fitted to the outer periphery of the intermediate section 22*a* in a manner such that a lateral portion of the sealing member 5*a* abuts on the stepped part 25*a*, thereby obtaining the waterproof connector 1*a*.

Figure 16:
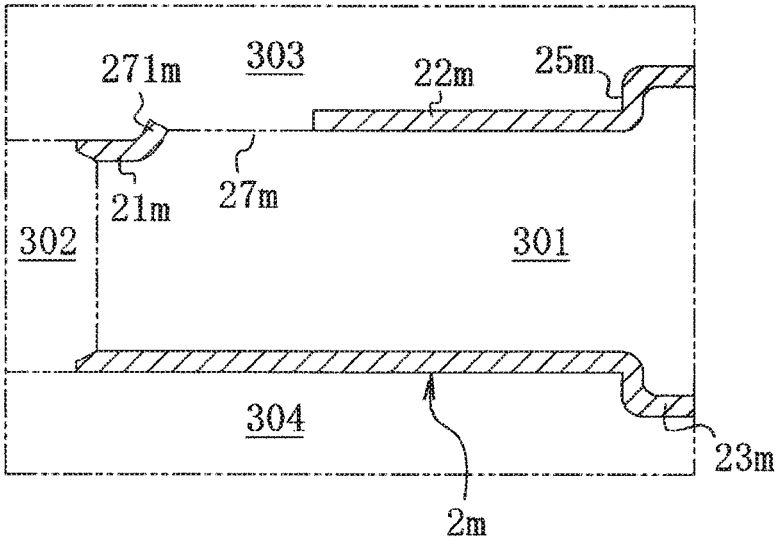
FIG. 16 is a conceptual explanatory view showing a step of forming a shell by die casting according to a modification of the second embodiment.

A shell of an entirely seamless and substantially tubular shape having an engagement hole can also be formed by die casting instead of the drawing press and the cut and bending. FIG. 16 explains formation of a shell 2*m* of an entirely seamless and substantially tubular shape having a cut and bent part 271*m* and an engagement hole 27*m* by die casting according to a modification.

The structure of the shell 2*m* is basically the same as that of the shell 2*a*. The shell 2*m* includes a front section 21*m*, an intermediate section 22*m*, a rear section 23*m*, a stepped part 25*m*, and the engagement hole 27*m* having the cut and bent part 271*m* formed on the upper surface of the front section 21*m*. The shell 2*m* does not include the stepped part 24*a*. The intermediate section 22*m* has an upper surface formed at a height substantially corresponding to the position of the upper end of the cut and bent part 271*m*.

Die casting is performed with a mold 301 as a core located on a rear side, a mold 302 as a cavity located on a front side, and a mold 303 and a mold 304 as slide cores located by being moved slidingly from peripheral sides, thereby forming the shell 2*m* into a designated shape. Then, all the molds 301 to 304 are moved backward to extract the shell 2*m*. The upper surface of the intermediate section 22*m* is formed in the position substantially corresponding to the upper end of the cut and bent part 271*m*. This prevents the molds 301 and 302 from interfering with the shell 2*m* during the action of moving the molds 301 and 302 forward in preparation for the casting and the action of moving the molds 301 and 302 backward in preparation for the extraction after the casting.

Then, like in the step performed relating to the shell 2*a*, the support 3*a* with the contact terminals 4*a* formed by insert molding is fitted in the intermediate section 22*a* and accommodated in the shell 2*m* so as to form a watertight structure. Further, cutting and bending work is performed on a designated place of the rear section 23*m* to form a bent part and the bent part is made to abut on the rear surface 313*a* of the support 3*a*. Further, the sealing member 5*a* is fitted to the outer periphery of the intermediate section 22*m* in a manner such that a lateral portion of the sealing member 5*a* abuts on the stepped part 25*m*, thereby obtaining the waterproof connector 1*a*.

According to the second embodiment, like that of the first embodiment, the waterproof connector 1*a* is formed by accommodating the support 3*a* supporting the contact terminals 4*a* in the seamless shell 2*a* or 2*m*. As a result, the length of the connector can be reduced while waterproof performance is ensured. Further, the absence of a resin housing outside the shell 2*a* or 2*m* can make the connector thinner by the thickness of the housing. This can reduce an area taken up by the connector to increase an available area inside the electronic equipment, thereby achieving layout design of the electronic equipment more freely and contributing to size reduction of the electronic equipment.

Eliminating the need of providing a resin housing outside or behind the shell 2*a* or 2*m* makes a resin material for the resin housing unnecessary. Thus, manufacturing cost can be reduced.

The shell 2*a* or 2*m* of a seamless and substantially tubular shape has no seam that is likely to cause fracture if a plug inserted in the connector is pried strongly or prying force is applied to the plug many times. This can increase the strength and durability of the shell 2*a* or 2*m* dramatically.

As a result of the abutting contact between the sealing member 5*a* and the stepped part 25*a*, the sealing member 5*a* can be located in and attached to a designated position on the outer periphery of the shell 2*a* or 2*m* and can be attached to this designated position stably.

The structure of the shell 2*a* or 2*m* having the engagement hole 27*a* or 27*m* with the cut and bent part 271*a* or 271*m* can be achieved only by forming the engagement hole 27*a* or 27*m* with the cut and bent part 271*a* or 271*m* in an appropriate part independently of a different part. This increases a degree of freedom of a shape and provides responsiveness to customization easily. Thus, various requests for the shape of the shell 2*a* or 2*m* can be responded flexibly while the strength and durability of the shell 2*a* or 2*m* are increased. Further, the size of the shell 2*a* or 2*m* can be reduced by reducing the height of the shell 2*a* or 2*m* in a thickness direction, for example, while the strength and durability of the shell 2*a* or 2*m* are increased. Additionally, providing the sealing member 5*a* around the outer periphery of the shell 2*a* or 2*m* and behind the engagement hole 27*a* or 27*m* prevents entry of water through the engagement hole 27*a* or 27*m*. This makes it possible to ensure waterproof performance with the sealing member 5*a* without the need of providing a resin housing outside the shell 2*a* or 2*m*.

The watertight structure formed by the shell 2*a* or 2*m* and the support 3*a* fitted to and accommodated in the shell 2*a* or 2*m* can prevent entry of water from the inside of the shell 2*a* or 2*m* into a place adjacent to the circuit board of the electronic equipment reliably. The abutting contact of the rear surface 313*a* of the support 3*a* for example with the bent part 231*a* stabilizes a fitting condition of the support 3*a* while contributing to retention of the support 3*a*.

If the shell 2*a* of the waterproof connector 1*a* is formed by drawing press and cut and bending, the seamless shell 2*a* of high strength and high durability can be manufactured easily at low cost. The shape of the engagement hole 27*a* and that of the cut and bent part 271*a* formed by the cutting and bending can be changed flexibly and have a high degree of freedom, thereby providing responsiveness to customization more easily.

If the shell 2*m* of the waterproof connector 1*a* is formed by die casting, the seamless shell 2*m* of high strength and high durability can be manufactured easily at low cost. Further, the seamless and substantially tubular shape of the shell 2*m* and the engagement hole 27*m* can be formed in the same die casting step. This achieves efficient manufacture of high productivity.

Modifications of Embodiments

The invention disclosed in this specification includes, in addition to the structures according to respective inventions or embodiments, in an applicable range, a matter defined by modifying any of these partial configurations into other configurations disclosed in this specification, a matter defined by adding any other configurations disclosed in this specification to these partial configurations, or a matter defined into a generic concept by cancelling any of these partial configurations within a limit that achieves a partial operational advantage. The invention disclosed in this specification further includes the following modifications.

For example, the shell according to this invention is not limited to the shell 2, 2*a*, or 2*m* of the aforementioned embodiment but can be any shall of a seamless and substantially tubular shape. Examples of such a shell include a shell where the non-through recesses 26 in two places are connected to form a long and thin non-through recess in one place, a shell not having one or both of the stepped parts 24 and 25 or not having one or both of the stepped parts 24*a* and 25*a*, a shell having a fitting groove extending in a peripheral direction provided for fitting of the sealing member 5 or 5*a* or having a plurality of peripheral protruding strips protruding outward as in the aforementioned embodiment, and a shell not having the non-through recess 26 or not having the engagement hole 27*a*.

The engagement hole provided to the shell in this invention is not limited to the engagement hole 27*a* or 27*m* with the cut and bent part 271*a* or 271*m* of the aforementioned embodiment but can be any engagement hole that allows engagement of a hook of a plug.

The abutting part provided to the rear section of the shell in this invention can also be of any structure that allows the abutting part to abut on the rear surface of the support. The abutting part is not limited to the bent part 231*a* of the aforementioned embodiment, for example. The abutting part to abut on the rear surface of the support may be a protrusion protruding inward provided to the rear section of the shell, for example.

If drawing press is employed to form a shell such as the shell 2 without a through hole, the resultant shell may have a stepped peripheral surface without a part partially protruding outward from the peripheral surface or partially recessed inward from the peripheral surface. This shell is preferable as it can be formed only by the drawing press or can be formed with a minimum working step other than the drawing press.

The sealing member provided around an outer periphery in this invention can be located in any position not limited to a position around the outer periphery of the intermediate section 22 or 22*a* in the aforementioned embodiment. The position of the sealing member covered by this invention includes any position around the outer periphery of the shell where the performance of preventing entry of water into a place behind the sealing member can be ensured such as a position around the outer periphery of a place near the front end of the shell or a position around the outer periphery of the front section or the rear section of the shell. In the first embodiment, while waterproof performance is ensured, the sealing member 5 can be provided in any position around the outer periphery of the shell in the anterior-posterior direction, for example. In the second embodiment, while waterproof performance is ensured, the sealing member 5*a* can be provided in any position around the outer periphery of the shell 2*a* or 2*m* and behind the engagement hole 27*a* or 27*m*, for example.

The support of this invention can be of any structure that allows the support to be accommodated in a wall pattern in the shell. It is preferable that this structure allow the support to be fitted to and accommodated in a shell such as the shell 2, 2*a*, or 2*m* in terms of contribution to increase in attachment strength and water-tightness between the shell and the support.

During manufacture of the waterproof connector of this invention, the shell 2, 2*a*, 2*m*, etc. can be formed by a step not limited to the step of the aforementioned embodiment but can be formed by any step that allows formation of a shell. For example, the shell of this invention can be formed by metal powder injection molding (MIM) or using a 3D printer.

INDUSTRIAL APPLICABILITY

This invention is applicable as a waterproof connector used for electrical connection of various types of electronic equipment such as multifunctional mobile phones, multifunctional mobile information terminals, and mobile audio players.

REFERENCE SINGS LIST

1, 1*a* Waterproof connector
2, 2*a*, 2*m* Shell
21, 21*a*, 21*m* Front section
22, 22*a*, 22*m* Intermediate section
23, 23*a*, 23*m* Rear section
231*a* Bent part
24, 25, 24*a*, 25*a*, 25*m* Stepped part
26 Non-through recess
27*a*, 27*m* Engagement hole
271*a*, 271*m* Cut and bent part
3, 3*a* Support
31, 31*a* Body
311, 311*a* Front surface
312*a* Stepped surface
313*a* Rear surface
32, 32*a* Protruding part
4, 4*a* Contact terminal
5, 5*a* Sealing member
51, 51*a* Body
52, 52*a* Protruding strip
61 Receiving part
62 Sealing material
11 Bottom case
111 Opening for plug insertion
12 Top case
201 Metal flat plate
202, 203 Work
301 to 304 Mold

The invention claimed is:

1. A waterproof connector for electrical connection of electronic equipment, comprising:

a shell of a seamless and substantially tubular shape, the shell being made of metal and the shell having an outer peripheral surface around an entire perimeter of the shell that delineates an outer peripheral surface of the waterproof connector without a resin housing surrounding the shell between the shell and a case of the electronic equipment:

a resin support accommodated in the shell having a wall pattern closing the shell proximate the rear end of the shell:

a contact terminal supported by the resin support and extending through said wall pattern;

and a sealing member extending peripherally around the shell along only a portion of a length of the shell, with an inner peripheral surface of the sealing member contacting an outer peripheral surface of the shell.

2. The waterproof connector according to claim 1, wherein the shell is provided with a non-through recess formed so as to bulge outward and located in the shell at a front of said sealing member, the non-through recess allowing engagement of a hook of a plug.

3. The waterproof connector according to claim 1, wherein the shell is formed of a non-perforated surface extending at least in an area of the shell ahead of a front surface of the resin support.

4. The waterproof connector according to claim 1, wherein the shell is provided with an engagement hole that allows engagement of a hook of a plug, and the sealing member is provided around the outer periphery of the shell and behind the engagement hole.

5. The waterproof connector according to claim 1, wherein a rear-side receiving recess is filled with a sealing material, the receiving recess being formed by an interior of rear section of the shell and a rear surface of the resin support.

6. The waterproof connector according to claim 1, wherein the resin support is fitted in the shell in a watertight manner, and a rear section of the shell is provided with an abutting part abutting on a rear surface of the resin support.

7. An electronic equipment comprising the waterproof connector according to claim 1 and a case accommodating the waterproof connector, wherein a watertight structure is formed by pressing the sealing member directly or indirectly with the case.

8. A waterproof connector, comprising:

a shell of a seamless and substantially tubular shape, the shell being made of metal and the shell being without a resin housing outside the shell:

said shell having a plurality of sections along a length of the substantially tubular shape shell between a front end of the shell and a rear end of the shell, said plurality of sections having differing widths, a rearmost of said plurality of sections having a greatest width of said plurality of sections, and including a first step part stepping down in width between a width of said rearmost section and a narrower width of an adjacent one of said plurality of sections;

a resin support accommodated in the shell and having a wall pattern closing the shell proximate the rear end of the shell;

a contact terminal supported by the resin support and extending through said wall pattern; and a sealing member provided around an outer periphery of the shell around said adjacent one of said plurality of sections along said first step part.

9. The waterproof connector according to claim 8, wherein the first stepped part abuts the sealing member around the outer periphery of the shell.

10. The waterproof connector according to claim 8, wherein the shell is provided with a non-through recess formed so as to bulge outward and located in the shell at a front of said sealing member, the non-through recess allowing engagement of a hook of a plug.

11. The waterproof connector according to claim 8, wherein the shell is formed of a non-perforated surface extending at least in an area of the shell ahead of a front surface of the resin support.

12. The waterproof connector according to claim 8, wherein the shell is provided with an engagement hole that allows engagement of a hook of a plug, and the sealing member is provided around the outer periphery of the shell and behind the engagement hole.

13. The waterproof connector according to claim 8, wherein a rear-side receiving recess is filled with a sealing material, the receiving recess being formed by an interior of the rearmost section of the shell and a rear surface of the resin support.

14. The waterproof connector according to claim 8, wherein the resin support is fitted in the shell in a watertight manner, and a rear section of the shell is provided with an abutting part abutting on a rear surface of the resin support.

15. The waterproof connector according to claim 8, wherein said adjacent one of said plurality of sections is an intermediate section having a width that is intermediate between said rearmost section and a front section at a front side of said intermediate section, wherein said front section includes a hole or non-through recess that allows engagement of a hook of a plug.

16. An electronic equipment comprising the waterproof connector according to claim 8 and a case accommodating the waterproof connector, wherein a watertight structure is formed by pressing the sealing member directly or indirectly with the case.

* * * * *